United States Patent [19]

Sattelberg et al.

[11] Patent Number: 4,498,602

[45] Date of Patent: Feb. 12, 1985

[54] RESILIENT BLANKET WITH INTEGRAL HIGH STRENGTH FACING AND METHOD OF MAKING SAME

[75] Inventors: Stanley E. Sattelberg, Naperville; George A. Baker, Batavia, both of Ill.

[73] Assignee: Chicago Bridge & Iron Company, Oak Brook, Ill.

[21] Appl. No.: 559,485

[22] Filed: Dec. 8, 1983

[51] Int. Cl.[3] ..... B65D 7/22

[52] U.S. Cl. ..... 220/452; 220/422; 220/429

[58] Field of Search ..... 220/452, 466, 422, 429

[56] References Cited

U.S. PATENT DOCUMENTS

| | | | |
|---|---|---|---|
| 3,147,878 | 9/1964 | Wissmiller | 220/429 |
| 3,481,504 | 12/1969 | Nelson | 220/429 |
| 3,559,835 | 2/1971 | Lange | 220/422 |
| 3,612,332 | 10/1971 | Clapp | 220/452 X |
| 3,903,824 | 9/1975 | Laverman et al. | 220/429 X |
| 3,987,925 | 10/1976 | Sattelberg | 220/429 |

*Primary Examiner*—Steven M. Pollard

*Attorney, Agent, or Firm*—Marshall, O'Toole Gerstein, Murray & Bicknell

[57] ABSTRACT

A cryogenic storage tank having inner and outer storage vessels having spaced top, bottom, and upstanding side walls defining an annular insulating space therebetween. Granular insulating material is provided in the annular insulating space between the side walls, and a composite, resilient, insulating blanket, which remains elastically compressible at cryogenic temperatures and which has a flexible, high tensile strength facing on at least one side thereof, is likewise provided in the annular insulating space. The compressibility of the blanket compensates for dimensional changes in the annular insulating space, which would otherwise cause attrition of the granular insulating material, and the high tensile strength flexible facing on the blanket prevents local tearing or rupturing of the blanket when subjected to the vertical drag forces of the behavior of the granular material and due to the thermally induced changes in the dimensions of the annular insulating space.

A composite, resilient, insulating blanket provided by a sheet of fiber glass having a flexible layer of high tensile strength fiber glass bonded thereto by a fused film of polyethylene to increase the tensile strength of the blanket.

A method of making a composite, compressively resilient, high tensile strength, insulating blanket useable at cryogenic temperatures.

9 Claims, 6 Drawing Figures

RESILIENT BLANKET WITH INTEGRAL HIGH STRENGTH FACING AND METHOD OF MAKING SAME

BACKGROUND OF THE INVENTION

1. Field of the Invention

This invention relates generally to cryogenic storage tanks, and more particularly relates to a resilient, insulating blanket useable in such a tank and having a flexible, high tensile strength facing bonded to at least one side thereof to increase the strength of the blanket, and to a method of making the blanket.

2. Description of the Prior Art

One of the problems associated with the use of granular, insulating material, such as perlite, in the insulating space between the spaced walls of the inner and outer storage vessels of cryogenic storage tanks has been that of compaction, crushing, and attrition of the granular insulating material due to thermal expansion and contraction of the inner vessel. To overcome this problem, resilient, insulating blankets, which retain their compressive resilience at low temperatures, have been installed in the insulating space of the tanks to compensate for the aforementioned expansion and contraction of the inner and outer vessels. Examples of such arrangements are disclosed in the U.S. Pat. No. 3,147,878 Wissmiller and U.S. Pat. No. 3,612,332 Clapp.

While resilient, insulating blankets having low temperature compressive resiliency have heretofore been used to overcome the aforementioned problems, difficulties were sometimes encountered in the use of such blankets due to local tearing and rupturing of the blankets as a result of the large vertical drag forces imposed on the blankets from the granular insulating material. In other words, the recognized arching characteristic of the granular material, aggravated by settlement due to the changes in the dimensions of the insulating space of the tank, as the temperature of the tank went from ambient to cryogenic, and vice-versa, sometimes resulted in the imposition of vertical drag forces on the blanket which exceeded its tensile strength. When this occurred, the aforementioned local tearing or rupturing of the blanket took place, and portions of the blanket collapsed toward the bottom of the insulating space. Consequently, the capability of the tank to maintain cryogenic temperatures was substantially impaired, or lost, because the attrition rate of the granular insulating material substantially increased. The resulting perlite settlement also caused voids at the top of the shell and these voids, in turn, caused undesirable cooling of the outer tank walls.

In addition to the described problem, a separate problem was involved in installing the blankets. Several common methods of installation were to position a roll of glass cloth and one or two rolls of matted glass fibers constituting resilient blanket, either inside the tank roof above the annular space between the tank walls to be insulated, or outside the tank walls at the base of the tank walls to be insulated. As the glass cloth and blanket were unrolled simultaneously and lowered or raised into the annular space they were pinned together. This was tedious, time consuming and not enjoyable labor. Furthermore, as or after the pinned together material was installed, the blanket would sometimes tear in half and pull loose from the glass cloth, after the perlite was added, and thence fall to the bottom of the annular space. Since visability in the annular space was generally very poor the repair of a broken blanket was extremely uncomfortable and tedious.

SUMMARY OF THE INVENTION

Briefly described, in its broader aspects, the present invention contemplates a novel resilient, insulating blanket construction having a high strength facing on at least one side thereof such as to increase the tensile strength of the blanket. The blanket thus generally comprises a sheet of resilient, insulating material, having low temperature compressive resiliency, such as matted glass fibers, a layer of flexible strengthening material, such as fiber glass cloth, carried on at least one side of the sheet of resilient insulating material, and a film of flexible bonding material, such as sheet polyethylene, disposed between and bonded to the fiber glass blanket and the layer of fiber glass cloth. The bonded layer of fiber glass cloth serves to provide a composite structure having substantially increased tensile strength compared to that of the blanket alone and, consequently, provides resistance to local tearing or separation when the blanket is subjected to tensile stresses.

In its more specific aspects, the present invention contemplates a novel double-walled tank construction for storing materials at cryogenic temperatures, which retains its effectiveness to store materials and maintain the same at cryogenic temperatures, even after the tank has undergone numerous temperature change cycles during which the temperature has varied between ambient and cryogenic. Thus, the cryogenic tank construction of the present invention includes inner and outer storage vessels having upstanding, radially spaced, circular cylindrical side walls defining an annular, insulating space therebetween. A free mass of substantially free-flowing, light-weight, granular insulating material fills a vertical portion of the insulating annular space, and a resilient, insulating blanket of low temperature, compressively resilient material is also vertically disposed in the insulating annular space with one side of the blanket engaging one of the cylindrical side walls of the storage vessel and the other side of the blanket engaging the free mass of granular insulating material. A layer of flexible, strengthening material is bonded to the side of the blanket that engages the granular insulating material and serves to increase the tensile strength thereof. Consequently, the resistance of the blanket to localized tearing or rupturing, due to the vertical drag forces imposed on the blanket from the granular insulating material, is substantially increased.

The present invention also contemplates a novel method of making the resilient, insulating blanket herein disclosed, which includes the steps of engaging one side of a film of flexible bonding material with one side of a sheet or elongated strip of resilient, insulating material, engaging a layer of flexible, strengthening material with the film of bonding material, and raising the temperature of the assembly to a value sufficient to cause the bonding material to fuse the sheet or strip of resilient, insulating material to the layer of flexible strengthening material.

DESCRIPTION OF THE PREFERRED EMBODIMENTS

Figure 1:
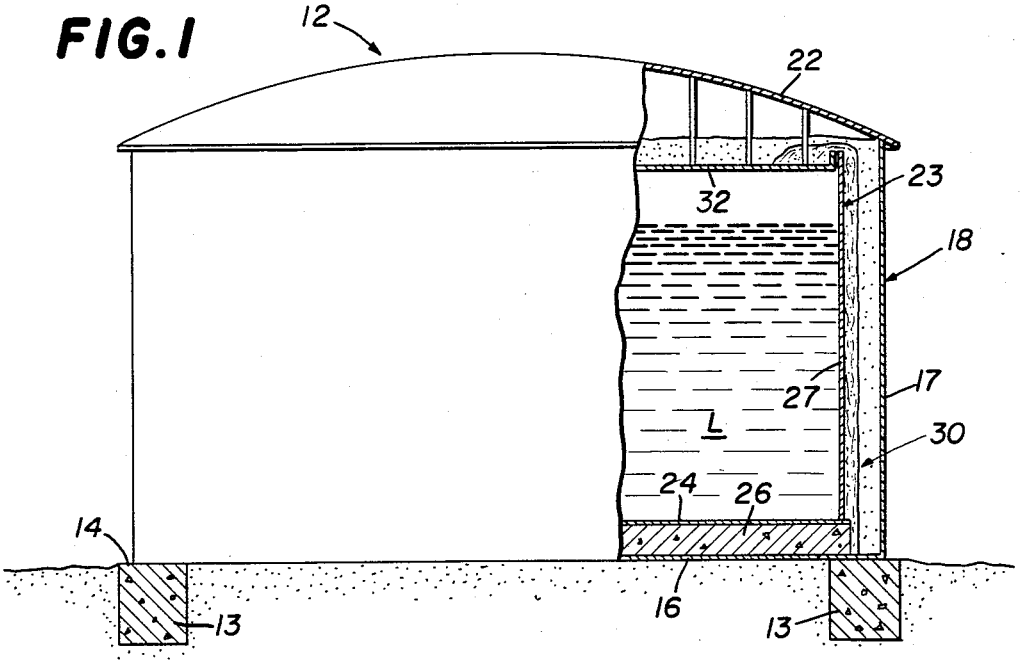
FIG. 1 is a vertical section, with portions in elevation, through a cryogenic storage tank having a resilient, insulating blanket, embodying the features of the present invention, disposed in the insulating annular space between the vertical side walls of the inner and outer vessels of the tank.
Figure 2:
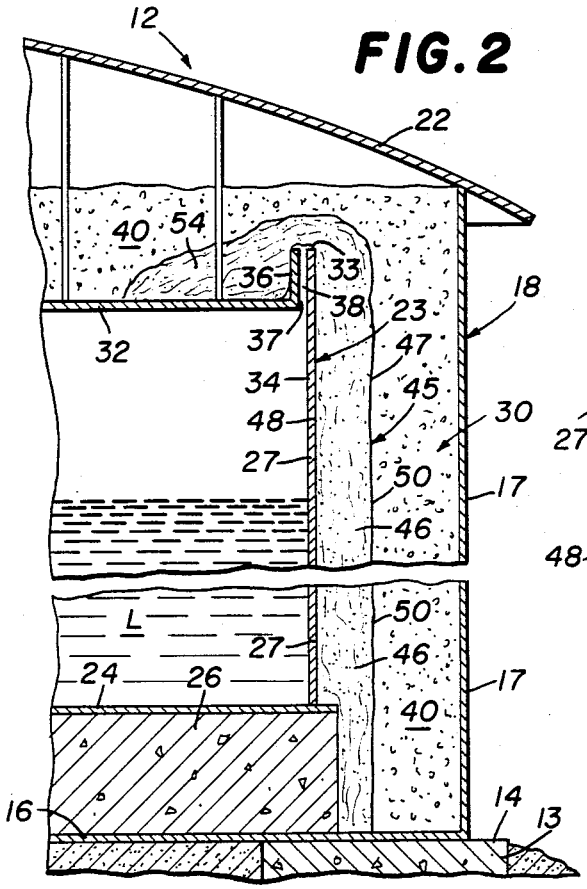
FIG. 2 is an enlarged, broken, view of part of the sectional portion of the tank illustrated in FIG. 1.
Figure 3:
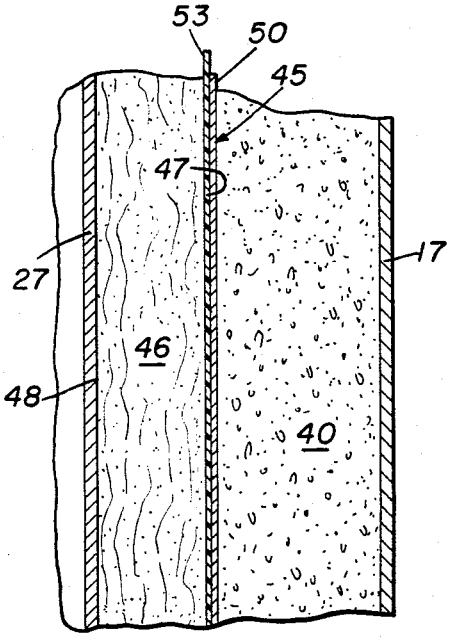
FIG. 3 is an enlarged, fragmentary vertical section of a portion of the insulating space between the side walls of the inner and outer vessels of the cryogenic tank illustrated in FIGS. 1 and 2 and showing additional details of the construction of the resilient blanket of the present invention.

In FIGS. 1, 2, and 3, a tank for storing materials at cryogenic temperatures, such as liquefied natural gas, liquefied petroleum gas, liquefied nitrogen, and liquefied ethylene, for example, is illustrated and indicated generally at 12. The tank 12, in the present instance, is shown resting on an annular foundation 13, which is preferably of concrete and set into the earth so that the upper surface, indicated at 14, of the foundation is substantially at ground level.

The tank 12 includes an annular metal plate 16, which rests on the upper surface 14 of the foundation 13 and is secured to the bottom edge of an upstanding cylindrical wall 17 comprising a part of an outer storage vessel of the tank 12. The outer vessel 18 also includes a top wall or dome-shaped roof 22, which is supported by the upper edge of the cylindrical side wall 17.

The tank 12 also includes an inner storage vessel, indicated generally at 23, having a flat wall or bottom 24 resting on a load bearing, insulating material 26, such as lightweight concrete or cellular glass, such as foam glass. The inner storage vessel 23 also includes an upstanding, circular cylindrical side wall 27, concentric with the side wall 17 and spaced inwardly therefrom to provide an annular insulating space 30 therebetween. The side wall 27 terminates below the roof 22, and a top wall or flat roof 32, which may be suspended from the roof 22 of the vessel 18, completes the upper boundary of the inner vessel 23. It should be noted that the diameter of the roof 32 is less than that of the side wall 27 and is spaced below the upper edge, indicated at 33, of the side wall. In addition, an annular flange 36 extends upwardly from the outer, circumferential edge, indicated at 37, of the roof 32 in spaced relation from the inner surface 34 of the wall 27 to define an annular gap 38 therebetween. The purpose of the gap 38 will be described more fully hereinafter.

The resilient insulating blanket of the present invention, to be hereinafter described, may also be used to advantage with double-domed storage tanks wherein the inner roof is joined to and supported by the inner side wall.

The annular insulating space 30 of the tank 12, and at least a portion of the space between the roofs 22 and 32, is preferably filled with granular insulating material, indicated generally at 40, such as expanded perlite. A quantity of liquefied material is shown contained in the inner vessel 23, and is indicated generally at L, such material being capable of being withdrawn from and replenished by an appropriate cryogenic loading and unloading system (not shown) which employs nozzles, valves, and pipes (also not shown) for this purpose.

In order to prevent compaction, crushing, and attrition of the granular perlite 40, due to thermally induced changes in the radial spacing of the walls 17 and 27, a composite, resilient, insulating blanket, indicated generally at 45, fills a portion of the annular space 30 between the side walls 17 and 27. The blanket 45 is formed from a material that is elastically compressible at cryogenic, as well as ambient, temperatures. While various materials may be used to provide the blanket 45, it is preferably formed from sheets or strips of matted glass fibers, which are formed into a resilient mass and held in place by means of a suitable binder. The fiber glass fibers of the fiber glass sheet 46 preferably have diameter averages of between 14 and 18 microns, and the binder for holding the fibers together is preferably a thermosetting phenolic binder, such as phenol-formaldehyde resin. The temperature at which the phenolic binder fuses the fiber glass fibers into a resilient sheet or strip is preferably between about 150 to 200 degrees Centigrade (302 to 392 degrees Fahrenheit).

According to the present invention, the blanket 45 includes a high strength facing that is bonded or otherwise secured to at least one side, indicated at 47 in FIGS. 2 and 3, of the fiber glass sheet 46 of the blanket, which is exposed to the perlite 40 and spaced from the side wall 17 of the outer vessel 18. The high strength facing is indicated generally at 50 and serves to increase the tensile strength of the blanket and thus reduce the possibility of local tearing or rupturing of the blanket 45, due to vertical drag forces imposed on the blanket by the perlite 40. Such drag forces are generated as a result of the granular nature of the insulation and aggravated by thermally induced, repeated changes in the spacing of the tank side walls 27 and 17.

Referring now to FIG. 3 in conjunction with FIG. 2, the aforementioned layer of high strength facing 50 is preferably provided by a layer of woven, fiber glass cloth that is bonded to the side 47 of the fiber glass sheet 46 so as to become an integral part thereof. In the present instance, the opposite side, indicated at 48, of the sheet 46 is disposed toward and engages the outer surface of the side wall 27 of the inner vessel 23. Instead of woven, fiber glass cloth, the high strength facing 50 could also be of a nonwoven, fiber glass fabric having randomly arranged glass fibers, or could be of woven or nonwoven synthetic fabric or cloth.

The layer of fiber glass cloth 50 may be adhered to the fiber glass sheet 46 in various ways. However, we have found that very good adhesion is obtained by interposing a film of polyethylene, indicated at 53 in FIG. 3, between the sheet of the fiber glass 46 and layer of fiber glass cloth 50 and heating the assembly to a temperature sufficient to cause the polyethylene film to melt and fuse the reinforcing layer of fiber glass cloth 50 to the fiber glass sheet 46. Preferably, the polyethylene film has a melting point of between about 110 to 140 degrees Centigrade (231 to 284 degrees Fahrenheit). Instead of polyethylene, films of polyvinyl chloride and synthetic rubbers and blends thereof could also be used. The thickness of the polyethylene film has been exaggerated for clarity of illustration in FIG. 3.

Sheets. strips, or rolls of the fiber glass blanket 45 are available from the Certain-Teed Corporation of Valley Forge, Pennsylvania under the trade name "Cryo-Blanket." In this regard, the blanket 45 may range in thickness of from between about two inches to six inches, have a width of between 48 to 84 inches, and is available in 50 to 120 foot length rolls. Consequently, a plurality of circumferentially-spaced, vertically extending lengths of the blanket 45 are installed in the insulating space 30 of the tank 12, prior to the addition of the perlite 40.

In this regard, it will be seen that the upper end portion, indicated at 54, of each blanket 45 extends inwardly across the gap 38 between the upper edge 33 of the inner vessel side wall 27 and onto the upper surface of the roof 32 of the inner vessel 23, in the manner illustrated in FIG. 2. Thus, the blanket 45 closes the gap 38 between the cylindrical side wall 27 and the annular flange 36 to prevent heat transfer through the gap 38. However, the gap 38 permits equalization of any pressure in the inner vessel 23 and the atmosphere. Vents (not shown) in the roof or deck 32 also contribute to the equalization of pressure between the inner vessel 23 and the atmosphere. A quantity of the perlite 40 overlies the upper end portion 54 of the blanket 45 to inhibit heat transfer from the space between the roofs 32 and 22 to the interior of the inner vessel 23.

Figure 4:
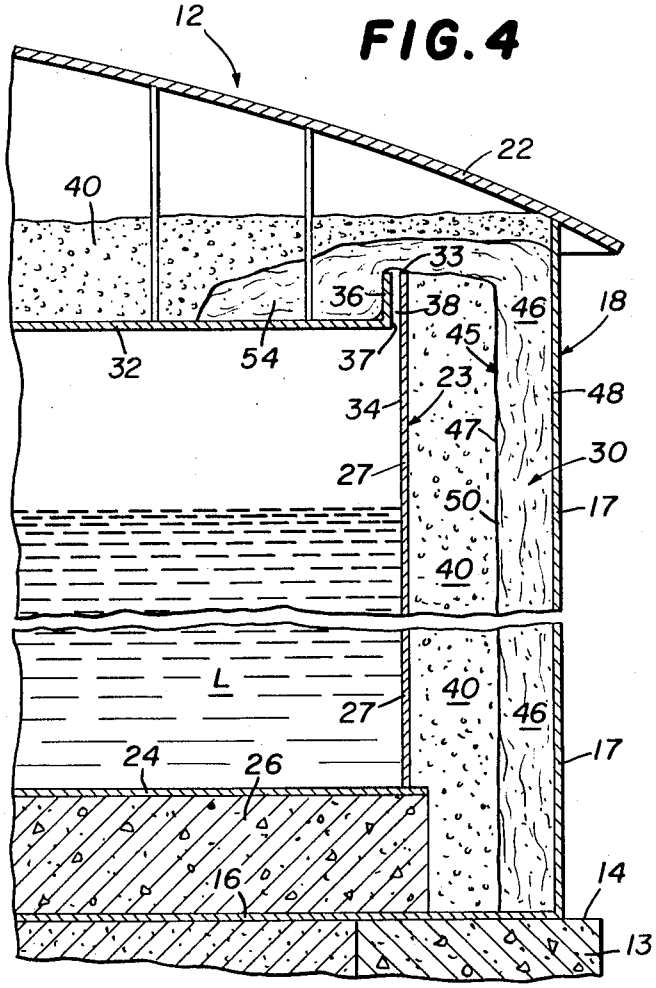
FIG. 4.is a view similar to FIG. 2 but showing an alternate location of the resilient blanket of the present invention in the insulating space of the tank.

Referring now to FIG. 4, an alternate location of the resilient blanket 45 of the present invention in the insulating space of the tank 12 is illustrated. Like reference numerals have been used to identify identical parts.

The tank construction illustrated in FIG. 4 is the same as that illustrated in FIGS. 1 and 2, except that the composite, resilient, insulating blanket 45 is positioned in the insulating space 30 so that the side 47 thereof having the layer of high tensile strength fiber glass cloth 50 bonded thereto faces toward the side wall 27 of the inner storage vessel 23, and the side 48 of the blanket engages the outer surface of the side wall 17 of the outer storage vessel 18. Consequently, the granular, insulating perlite 40 will engage the outer surface of the side wall 27 and the high strength fiber glass cloth 50 on the inner side of the blanket 45 when the blanket 45 is installed as illustrated in FIG. 4.

The tank construction illustrated in FIG. 4 possesses the same advantages as the tank construction illustrated in FIGS. 1–3, inclusive, but may be preferred in certain installations over the construction illustrated in FIGS. 1–3, inclusive.

Alternately, another insulating blanket 45 could be positioned in the insulating space 30, so as to engage the outer side of the inner side wall 27, in the manner of the tank construction illustrated in FIGS. 1, 2, and 3. Thus, in the aforementioned alternate construction, two radially spaced, circumferentially extending layers of insulating blankets would be provided in the space 30 with the perlite 40 filling the space between the layers.

Figure 5:
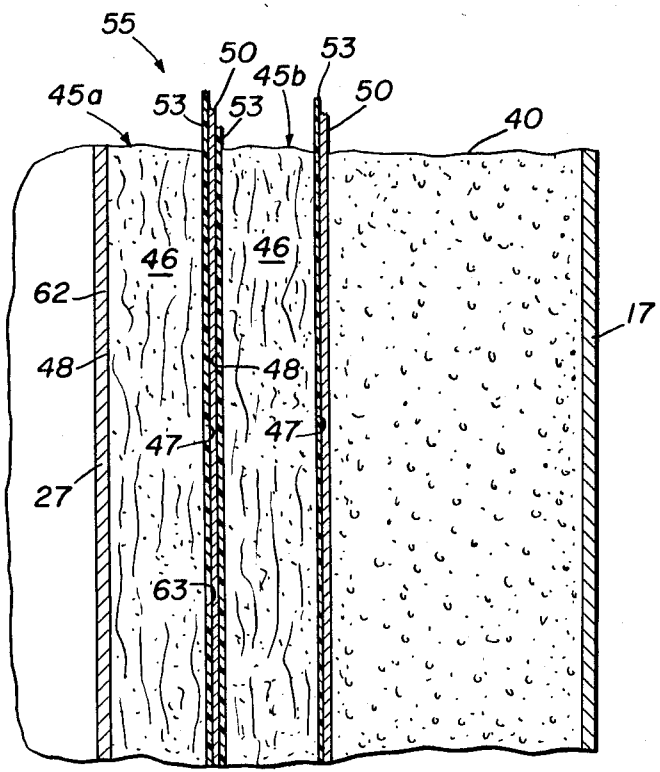
FIG. 5 is a fragmentary vertical section, similar to FIG. 3, showing an alternate, resilient, insulating blanket construction embodying the features of the present invention.

In FIG. 5, an alternate composite, resilient blanket construction is fragmentarily illustrated, the latter embodying the features of the present invention and being indicated generally at 55. Since most of the components of the blanket construction 55 are identical with those utilized in the blanket 45, like reference numerals have been used to identify these parts.

As will be apparent from FIG. 5, the resilient blanket 55 includes a radially juxtaposed pair of blankets 45, which are respectively indicated at 45*a* and 45*b* in FIG. 5, the blankets 45*a* and 45*b* being arranged with their fiber glass cloth facings 50 disposed on the radially outer sides 47 of the fiber glass sheets 46 thereof. In order to provide a unitary assembly, a film of polyethylene 53 is disposed between the inner side 48 of the blanket 45*b* and the outer side of the fiber glass cloth facing 50 of the blanket 45*a* at the time the blanket 55 is heated to melt the polyethylene films. Consequently, the fiber glass cloth facing 50 of the blanket 45*a* will simultaneously fuse to the outer side 47 of the fiber glass sheet 46 of the blanket 45*a* and to the inner side 48 of the fiber glass sheet 46 of the blanket 45*b*.

The blanket 55 may be arranged in the annular insulating space 30 of the tank 12 in the same manner as the blanket 45. As shown in FIG. 5, the fiber glass cloth facing of the blanket 45*b* is spaced from the inner surface of the outer side wall 17, and the inner side face 48 of the sheet 46 of the blanket 45*a* is engaged with the inner surface of the inner wall 27.

As in the blanket 45, the sheets 46 of resilient, insulating material of the blankets 45*a* and 45*b* could be other than fiber glass, and the bonding films 53 could be other than polyethylene.

The extra thickness of the blanket 55 renders it suitable for use in installations where relatively large changes in the radial dimensions of the insulating space 30 will occur, such as when extremely low cryogenic temperatures will be developed in the inner vessel 23 of a very large storage tank. Alternately, two or more radially juxtaposed, circumferentially extending layers of the blankets 45 could be emloyed in the space 30 where extra thickness of insulating material is needed to insulate large-sized tanks.

Figure 6:
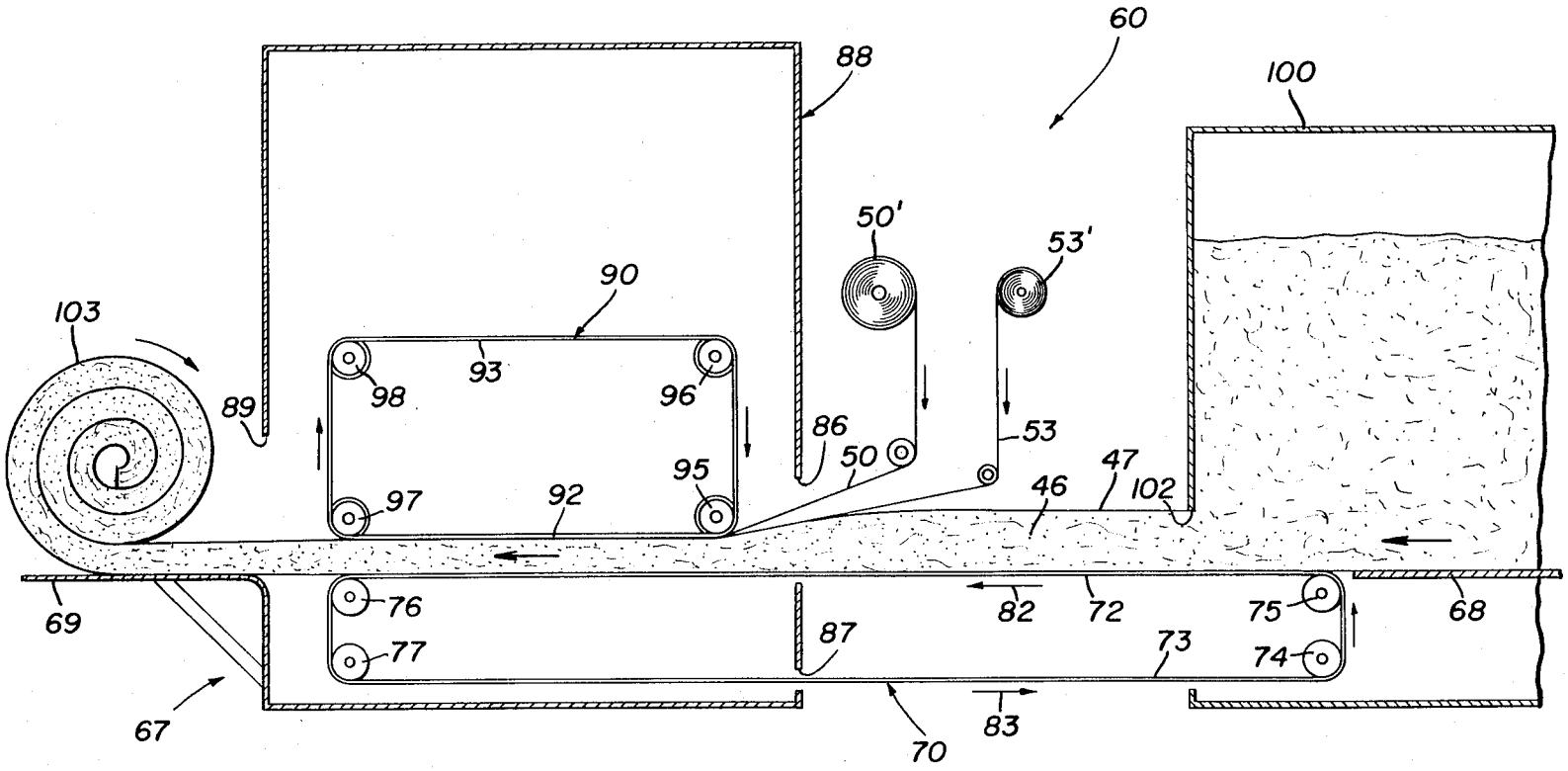
FIG. 6 is a diagrammatic vertical section, with some parts in elevation, of an apparatus for performing a method for making a resilient, insulating blanket embodying the features of the present invention.

Referring now to FIG. 6, an exemplary apparatus, indicated generally at 60, for carrying out a novel method of making the composite, resilient, insulating blanket of the present invention, as a continuous process, is illustrated. Like reference numerals have been used to identify the previously described parts of the blanket 45.

The apparatus 60 may thus comprise an elongated, horizontally extending, divided, platform 67 having spaced sections 68 and 69. An endless belt conveyor 70 is positioned between the platform sections 68 and 69, the conveyor having horizontally extending, vertically spaced upper and lower runs 72 and 73, respectively. The upper and lower runs 72 and 73 extend around two pair of spaced rollers 74,75 and 76,77, one or more of which may be driven by a suitable power source (not shown) to effect movement of the belts 72 and 73 in the directions indicated by the arrows 82 and 83, respectively. The downstream portions of the upper and lower runs 72 and 73 of the conveyor 70 extend into openings 86 and 87 in an oven 88. The oven 88 includes an exit opening 89, through which the completed blanket passes.

To assure bonding of the fiber glass cloth facing 50 to the fiber glass sheet 46 of the blanket, another endless belt conveyor 90 is provided in the oven 88. The conveyor 90 includes a lower and upper run 92 and 93, respectively, which pass around and are driven by two horizontally spaced pair of rollers 95,96 and 97,98. The space between the lower run 92 of the conveyor 90 and the upper run 72 of the conveyor 70 is less than the unstressed thickness of the fiber glass sheet 46 so that the sheet or strip 46 is compressed as it passes between the conveyors 70 and 90.

To continuously apply a film of polyethylene 53 to an overlying layer of fiber glass cloth 50 to the upper surface of the fiber glass strip 46 moving on its path through the apparatus 60, rolls, indicated at 53' and 50', of the polyethylene film 53 and fiber glass cloth 50 are mounted above the moving strip of fiber glass 46 in the vicinity of the oven 88. Thus, as the strip or sheet of fiber glass 46 advances on the conveyor 70, a continuous film of polyethylene and a continuous layer of fiber glass cloth is drawn from the rolls 53' and 50', respectively, and applied to the strip 46.

In order to provide the fiber glass sheet or strip 46, the apparatus 60 includes a receptacle 100 in which a quantity of mixed glass fibers and a thermosetting binder is stored. The receptacle 100 is located upstream from the rolls 53' and 50' and has an orifice 102 through which the sheet or strip 46 emerges and is deposited on the upper run 72 of the conveyor 70.

According to the present invention, melting of the polyethylene film 53 to fuse the fiber glass cloth 50 to the fiber glass sheet or strip 46 and setting of the thermosetting binder and glass fibers in the sheet or strip 46 takes place substantially concurrently as the sheet 46, film 53, and layer of fiber glass cloth 50 pass through the oven 88. In this regard, we have found that the desired setting of the binder in the sheet 46 and the melting of the polyethylene film 53 occurs when the temperature of the oven 88 is about 450° F. (232° C.).

The method performed by the apparatus 60 thus includes the steps of advancing a quantity of mixed glass fibers and a thermosetting resin as a sheet or strip along a path, applying a fusible film, such as a flexible film of polyethylene, to one side of the sheet or strip of resilient, insulating material, such as the fiber glass sheet 46, applying a layer of flexible, high tensile strength material, such as the fiber glass cloth 50, to the opposite or upper side of the polyethylene film, and then raising the temperature of the assembly to a value sufficient to cause substantially concurrent setting of the thermosetting binder and glass fibers in the sheet or strip 46 and melting of the polyethylene film 53 to fuse the layer of fiber glass cloth 50 to the sheet or strip 46 of fiber glass.

To assure complete bonding of the layer of fiber glass cloth 50 to the fiber glass sheet or strip 46, the spacing between the upper run 72 of the conveyor 70 and the lower run 92 of the conveyor 90 is less than the unstressed thickness of the fiber glass sheet or strip 46. Thus, the method of making the blanket 45 of the present invention may include the additional step of applying a compressive force to the layer of fiber glass cloth and polyethylene film while the strip is being heated to fuse the fiber glass cloth to the fiber glass sheet.

After the layer of fiber glass cloth 50 has been bonded to the fiber glass sheet or strip 46 in the oven 88, the completed composite blanket 45 may be cut into appropriate lengths or formed into a roll, indicated at 103 in FIG. 6.

The apparatus 60 could also be used to form the insulating blanket 55 illustrated in FIG. 5 by feeding two previously formed blanket strips or sheets through the oven 89 with a film of polyethylene 53 from the roll 53' interposed between the blanket strips.

While one or more embodiments of the invention have been herein illustrated and described in detail, it will be understood that modifications and variations thereof may be effected without departing from the spirit of the invention and the scope of the appended claims.

We claim:

1. A tank for storing liquids at cryogenic temperatures, comprising:

an inner storage vessel for receiving and retaining the liquids and having top and bottom walls and an upstanding cylindrical side wall;

an outer vessel enclosing said inner storage vessel and having top and bottom walls and an upstanding cylindrical side wall respectively spaced from the top, bottom, and cylindrical side wall of said inner storage vessel, said spaced cylindrical side walls defining an annular insulating space therebetween;

a composite resilient blanket having opposite sides and a low temperature compressive resiliency disposed in and filling a portion of said insulating space between said cylindrical side walls;

a free mass of substantially free-flowing, lightweight, granular insulating material disposed in the remainder of said insulating space between said cylindrical side walls;

the compressive resiliency of said composite blanket being such as to compensate for changes in the radial thickness of said annular insulating space between said cylindrical side walls, due to expansion or contraction of one or both of said vessels relative to the other of said vessels, so that attrition of said mass of granular insulating material is minimized; and at least one side of said composite resilient blanket having a layer of flexible, strengthening material bonded thereto, said layer of strengthening material being effective to resist the vertical drag forces imposed on said blanket by said free flowing mass of granular insulating material during relative expansion and contraction of the cylindrical side walls of said vessels and to prevent said blanket from shifting downwardly in said insulating space in the event of local tearing or rupturing of the same.

2. The cryogenic tank of claim 1, in which said inner and outer cylindrical side walls have opposed facing surfaces, said layer of strengthening material on said one side of said blanket engages said free-flowing granular insulating material, and said other side of said blanket engages the facing surface of one of said vessel side walls.

3. The cryogenic tank of claim 2, in which said other side of said blanket engages the facing surface of said inner side wall.

4. The cryogenic tank of claim 2, in which said other side of said blanket engages the facing surface of said outer side wall.

5. The cryogenic tank of claims 1, 2, 3, or 4, in which a plurality of circumferentially arranged, vertically extending lengths of said composite resilient blanket are provided in said annular insulating space to provide a circumferentially contiguous layer of insulation between said cylindrical side walls.

6. The cryogenic tank of claim 1, in which said inner and outer cylindrical side walls have opposed facing surfaces, at least a pair of radially juxtaposed pair of said composite resilient blankets disposed in and filling a portion of said annular insulating space, each of said blankets has radially inner and outer sides, a layer of flexible strengthening material is bonded to the radially outer side of each of said blankets, the radially inner most side of the radially inner one of said juxtaposed blankets engages the facing surface of the inner cylindrical side wall of said tank, the radially inner side of the outer most one of said juxtaposed blankets engaging the layer of flexible strengthening material on said radially inner most blanket, and the layer of strengthening material on the radially outer side of the radially outer one of said juxtaposed blankets is spaced from the facing surface of said outer cylindrical side wall of said tank to define the remainder of said insulating space therebetween.

7. The cryogenic tank of claim 6, in which the layer of strengthening material that is bonded to the radially outer side of the radially inner one of said juxtaposed blankets is also bonded to the radially inner side of the radially outer one of said blankets.

8. The cryogenic tank of claim 1, in which said inner and outer cylindrical side walls have opposed facing surfaces, a radially juxtaposed plurality of said composite resilient blankets are disposed in and fill a portion of said annular insulating space, one side of one of said blankets is disposed toward said insulating material, and said layer of said flexible, strengthening material is bonded to said one side of said one blanket.

9. The cryogenic tank of claims 6, 7, or 8, in which a plurality of circumferentially arranged, vertically extending lengths of said composite resilient blankets are provided at least in said annular insulating space to provide two, circumferentially, continguous, layers of insulation between said cylindrical side walls.

* * * * *

UNITED STATES PATENT AND TRADEMARK OFFICE

CERTIFICATE OF CORRECTION

PATENT NO. : 4,498,602

DATED : February 12, 1985

INVENTOR(S) : Stanley Elmer Sattelberg and George Allen Baker

It is certified that error appears in the above-identified patent and that said Letters Patent is hereby corrected as shown below:

Column 6, line 30, change "emloyed" to --employed--; column 8, line 60, delete "pair of said"; column 10, line 12, delete "at least", line 13, after "provide" insert --at least-- and change "continguous to --contiguous--

Signed and Sealed this

Second Day of July 1985

[SEAL]

*Attest:*

DONALD J. QUIGG

*Attesting Officer*

*Acting Commissioner of Patents and Trademarks*